United States Patent [19]

Kikutani et al.

[11] Patent Number: 4,610,626

[45] Date of Patent: Sep. 9, 1986

[54] HIGH LOAD GAS COMBUSTION APPARATUS

[75] Inventors: Fumitaka Kikutani, Nara; Koro Furumai, Ikoma; Masahiro Indou, Tenri; Kazuo Fujishita, Yamatokoriyama, all of Japan

[73] Assignee: Matsushita Electric Industrial Co., Ltd., Kadoma, Japan

[21] Appl. No.: 622,744

[22] Filed: Jun. 20, 1984

[30] Foreign Application Priority Data

Jun. 23, 1983 [JP] Japan ..... 58-113725
Jul. 20, 1983 [JP] Japan ..... 58-113286[U]
Sep. 14, 1983 [JP] Japan ..... 58-169635

[51] Int. Cl.[4] ..... F23D 15/00
[52] U.S. Cl. ..... 431/351; 431/352
[58] Field of Search ..... 431/351, 352, 114; 126/91 S; 239/424.5, 430, 431

[56] References Cited

U.S. PATENT DOCUMENTS 3,494,711 2/1970 Spielman .
3,592,578 7/1971 Weatherston ..... 431/351
4,311,451 1/1982 Matumoto et al. ..... 431/352

*Primary Examiner*—Margaret A. Focarino
*Assistant Examiner*—Noah Kamen
*Attorney, Agent, or Firm*—Spencer & Frank

[57] ABSTRACT

A high load gas combustion apparatus for use mainly in domestic combustors which require a low noise level and compactness. Some of the air for burning supplied from a fan is suctioned to fuel gas jetted through a nozzle to produce a mixture in a mixing tube section, which is then introduced to a mixture chamber defined by a burner body having a uniform shape in the lengthwise direction. The mixture flows into a downstream combustion chamber at a relatively low speed through a flame port section which is incorporated in the burner body on the downstream side of the mixture chamber, and which comprises a number of flame ports having a large opening ratio. The majority of air is supplied to air chambers on both sides of the mixture chamber partitioned by the burner body therefrom. The air chambers and the combustion chamber are partitioned by an air jet plate which includes a number of air ports arranged in wave-like form in the oblique portion thereof and a number of flame retention air ports arranged in the lengthwise direction of the flame port section. Some of the air supplied to the air chambers is supplied under reduced pressure to a flame retention chamber, which is constituted by a recess formed in a part of the burner body on either side of the flame port section, through small gaps formed between the air jet plates and the side wall of the recess, and then flows into the combustion chamber at a lower speed from both sides of the flame port section through the flame retention air ports, thus ensuring flame retention. The majority of the air supplied to the air chambers flows into the combustion chamber through the air ports so as to cross the direction of flow of the mixture for producing a steady flame along the air ports arranged in zigzag form, thus greatly enlarging the combustion reaction area.

16 Claims, 14 Drawing Figures

HIGH LOAD GAS COMBUSTION APPARATUS

BACKGROUND OF THE INVENTION

1. Field of the Invention

This invention relates to a high load gas combustion apparatus for use mainly in domestic combustors, in which a fan is used to forcibly supply air for burning to promote combustion reaction and shorten the flame length, thus achieving reduction in size of the combustion chamber and hence the entire apparatus, and in which the fan is a relatively small-sized fan to provide low supply pressure for ensuring combustion at a low noise level.

2. Prior Art

In a conventional high load gas combustion apparatus in which air for burning is supplied forcibly, air ports of different sizes were arranged in the form of multiple stages relative to the direction of flow of a mixture, and secondary air was supplied to the flame at a fairly high speed mainly for the purpose of effecting turbulent combustion. A typical example of such an apparatus is disclosed in U.S. Pat. No. 3,494,711, which is shown in FIG. 1. The illustrated example is a burner for installation in a flow of high-speed gas of low oxygen concentration. A mixture flows into a combustion chamber 4 from a mixture chamber 2 formed in a burner body 1 through flame ports 3 comprising a number of small holes arranged in the form of a longitudinal row. Fresh air passes both sides of the burner body 1 from a supply chamber 5 and then reaches a fresh air chamber 6. Some fresh air is supplied to the combustion chamber 4 through parallel air ports 7 which comprise a number of relatively small holes and are arranged near the flame ports 3, while the remaining fresh air is supplied to the combustion chamber 4 through oblique air ports 9 which comprise a number of relatively large holes and are arranged in an oblique plate 8.

The burner thus constructed has the following disadvantages:

(1) The flow rate of fresh air jetting out of the parallel air ports 7 becomes nearly equal to that of fresh air jetted out of the oblique air ports 9 because of the absence of a special means for reducing pressure. For this reason, when air supply pressure produced by the fan is raised, the flow rate of fresh air from the parallel air ports 7 is increased correspondingly so that the effect of flame retention will be lost;

(2) Because the oblique air ports 9 and jet ports 12 are bored in the form of multiple stages in the oblique plate defining the combustion chamber to supply fresh air and gas of low oxygen concentration, respectively, flames formed to extend toward the downstream side are disturbed by air jetted and supplied from the oblique air ports 9 or jet ports 12 located on the relatively upstream side. Particularly, in the case of using gas fuel having lower combustion velocity, there are produced discontinuous and unsteady flame zones, thus resulting in high combustion noise; and (3) The flame ports 3 comprise a number of small holes arranged in the form of a longitudinal row and the total area of flame ports is small. With the increasing combustion rate, therefore, the mixture supplied from the flame ports has a higher jet speed, whereby the aforesaid disturbance of unsteady flame zones is enlarged and the combustion noise is correspondingly further increased.

These disadvantages made it impossible for the prior art apparatus to be directly applied to domestic combustors which require a low noise level and compactness, and to be universally used for various types of gas fuel.

SUMMARY OF THE INVENTION

It is an object of the present invention to greatly increase the reaction area and achieve high load combustion with steady laminar flames of smaller length even at such a set speed of secondary air as under lower air supply pressure, by supplying secondary air at a relatively low speed to both sides of a flame port section from depressurized flame retention chambers through flame retention air ports so as to better ensure flame retention and by producing a steady, continuous flame zone along a number of air ports arranged in a zigzag or wove-like form on inclined air jet plates for various types of gas fuel having different combustion velocities, as well as to reduce the size of the entire combustion apparatus including its fan, to enable the apparatus to be universally used for various types of gas fuel and to provide a lowered noise level.

The present invention is further intended to ensure still greater reduction both in size of the entire combustion apparatus and in noise level by such a construction that the flame section comprises flat plates bent in the direction perpendicular to the direction of flow of the mixture into a zigzag form so as to make contact with each other at the central part of the flame port section, thus reducing the jet speed of a mixture due to the increased flame port area and making the jet speed of a mixture on both sides of the flame port section near the air ports higher than that of a mixture at the center thereof, or that a porous flat plate is bent into a polygonal or parabolic form to be projected into the combustion chamber, thus causing some of the mixture to jet in the direction toward the air ports.

Another object of the present invention is to achieve perfect combustion with a smaller air excess ratio at all times even under remarkable variations of the combustion rate by arranging the zigzag-like air ports with the crest portion projecting toward the downstream side in the form of a spire so as to supply a larger quantity of secondary air on the upstream side so that the flame zone is always formed along the air ports in accordance with the combustion rate.

DETAILED DESCRIPTION OF THE PREFERRED EMBODIMENTS

Figure 1:
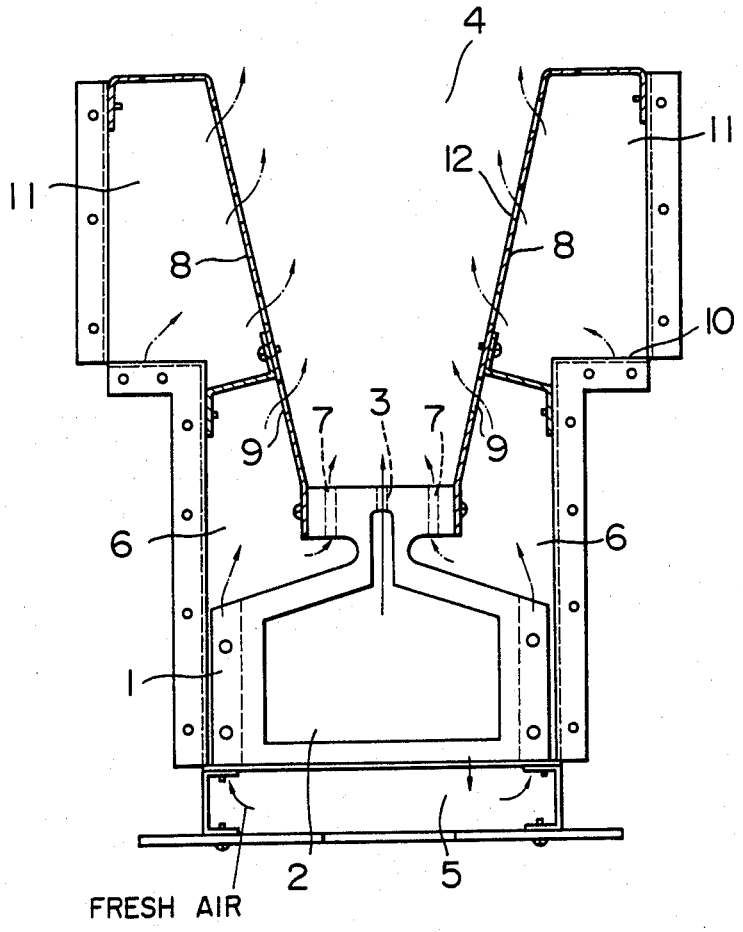
FIG. 1 PRIOR ART
FIG. 1 is a sectional view of the conventional burner.
Figure 2:
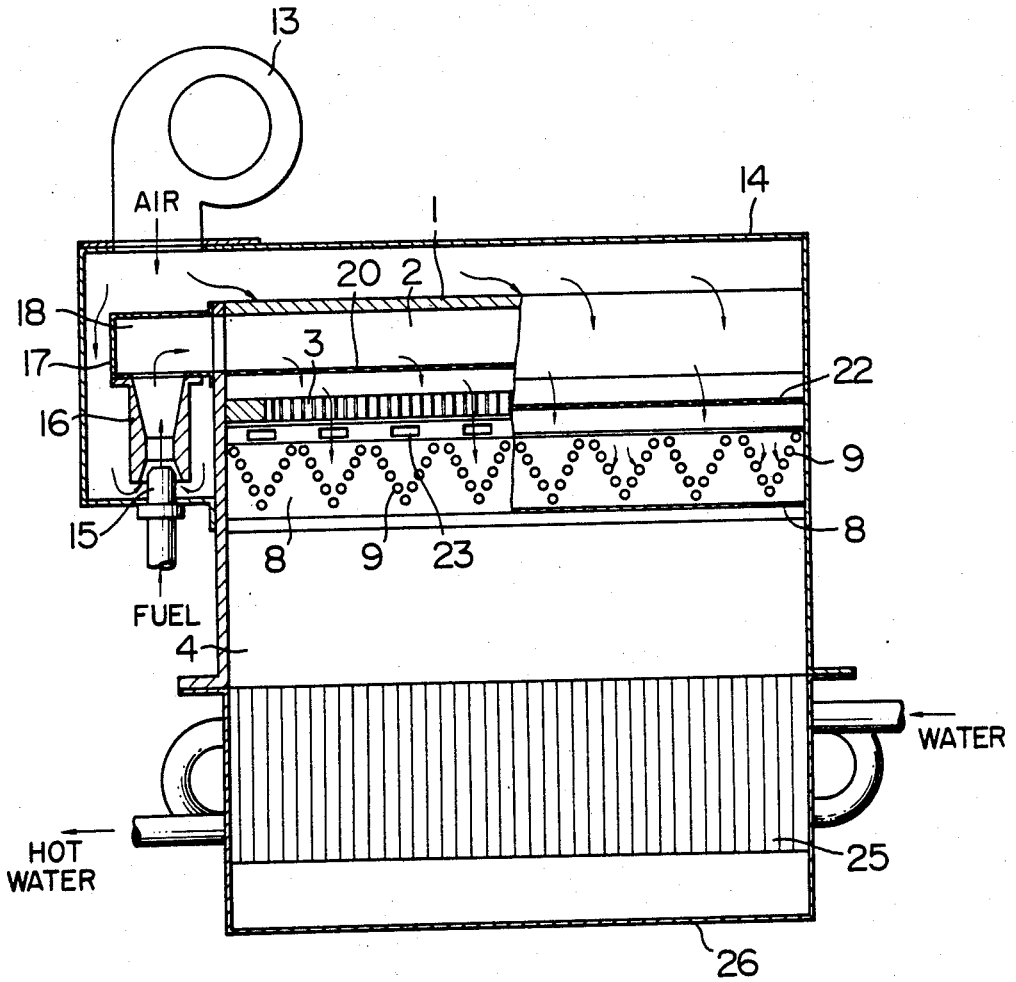
FIG. 2 is a general longitudinal sectional view of a case where the present invention is applied to an instantaneous hot water heater.
Figure 3A:
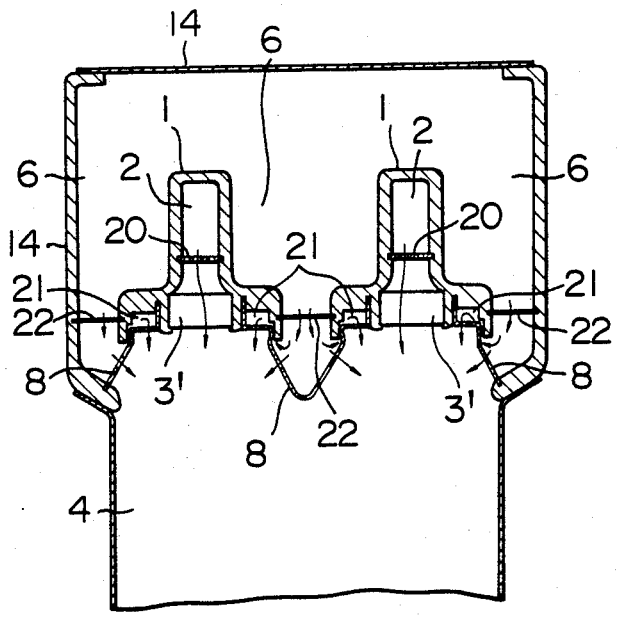
FIG. 3*a* is a partial transversal sectional view of FIG. 2.
Figure 3B:
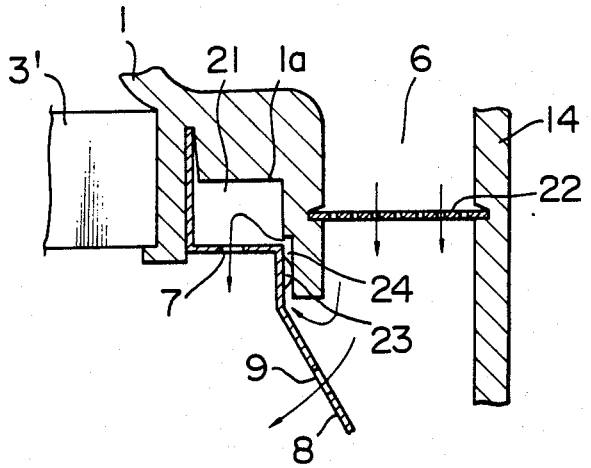
FIG. 3*b* is a partial enlarged view of FIG. 3*a*.
Figure 4A:
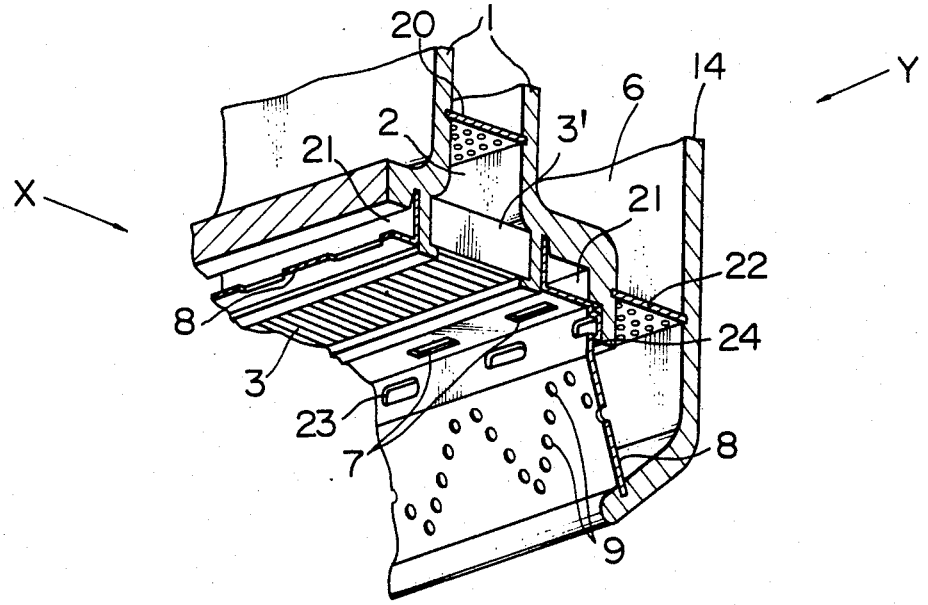
FIG. 4*a* is a partially sectioned perspective view of an essential part of FIG. 3*a*.
Figure 4B:
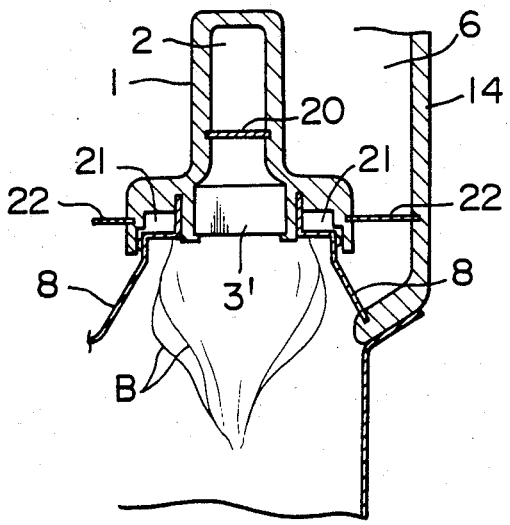
FIG. 4*b* is an explanatory view of a flame as seen in the Y-direction in FIG. 4*a*.

The present invention will be described with reference to FIGS. 2 to 8*c*, when applied to a domestic instantaneous hot water heater. In this type of hot water heater, flames are formed downwardly from above to perform downward combustion. It is to be noted that the same components in the figures as shown in FIG. 1 are designated by the same reference numerals.

Referring to FIGS. 2 to 4*b*, a fan 13 for supplying air for burning is attached to one end of a burner case 14 at one side thereof. A nozzle 15 for jetting fuel is provided to one end of the burner case 14 at the other side thereof to face a mixing tube 16. The mixing tube 16 is connected to a mixing tube connection box 17 so as to constitute a mixing tube section 18. The mixture tube connection box 17 is connected to two mixture chambers 2 each defined by a burner body 1 which is formed of a drawn aluminum material and has a uniform shape in the lengthwise direction. A porous equalizing plate 20 is inserted in each of the mixture chambers 2. On the downstream side of the equalizing plate there is disposed a flame port section 3' which comprises a number of flame ports 3 and has a large opening ratio, to be held between the side walls of the burner body 1 for partition of the mixture chambers 2 from the downward combustion chambers 4. Flame retention chambers 21 are formed on both sides of the flame port section 3' by providing recesses 1*a* at parts of the burner body 1. A plurality of air chambers 6 defined by both the burner bodies 1 and the burner case 14 are formed on both sides of the mixture chambers 2. A porous rectifying plate 22 is inserted on the downstream side of each air chamber 6. On the downstream side of the rectifying plate 22, air jet plates 8 are provided to form a partition between the combustion chambers 4 and the air chambers 6. In each air jet plate 8 there are bored a number of air ports 9 arranged in a zigzag or wave-like form at the oblique portion thereof, and a number of flame retention air ports 7 arranged in the lengthwise direction of the flame port section 3' at the horizontal portion thereof. Further, a number of small projections 23 are provided between the air ports 9 and the flame retention air ports 7 to form small gaps 24 between the small projections 23 and the part of the burner body 1 consituting the flame retention chambers 21. On the downstream side of the combustion chamber 4 there is provided a heat exchanger 25 inside an exhaust hood 26.

Operation of the combustion apparatus thus constructed will be described with reference to FIGS. 2 to 5*b*. Some of the air for burning supplied by use of the fan 13 is suctioned as primary air to fuel gas jetted from the nozzle 15 for mixing therewith to form a mixture while passing through the mixing tube section 18 composed of the mixing tube 16 and the mixing tube connection box 17, the mixture being distributed into two mixture chambers 2. The mixture is uniformalized in its flow through the equalizing plate 20 and then supplied to the flame port section 3' having a large opening ratio, thus flowing into the combustion chamber 4 at a relatively low speed through the flame ports 3. On the other hand, the majority of air for burning supplied by use of the fan 13 is supplied as secondary air to three air chambers 6. The majority of secondary air supplied from each of the air chambers 6 is directly jetted and supplied into the combustion at a relatively high speed making an angle relative to the flow of mixture also flowing into the combustion chamber 4. The remaining secondary air is supplied to the flame retention chambers 21 through the small gaps 24. At this time, since the small gaps 24 are very narrow passages, this renders a large pressure loss so that the flame retention chambers 21 have lower pressure than the air chambers 6. Accordingly, the secondary air flowing into the combustion chamber 4 from both sides of each flame port section 3' through the flame retention air ports 7 has a lower flow speed so as not to disturb the root of the flame, whereby flame retention is further ensured.

Figure 5A:
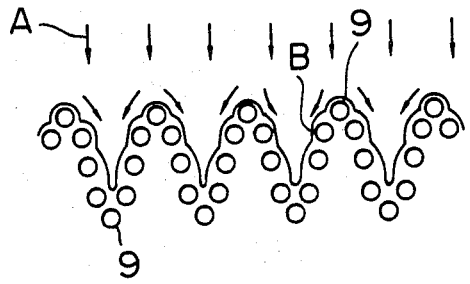
FIGS. 5*a* and 5*b* are explanatory views of the arrangement of air ports, flow of a mixture and flames formed along the air ports as seen in the X-direction in FIG. 4*a*.
Figure 5B:
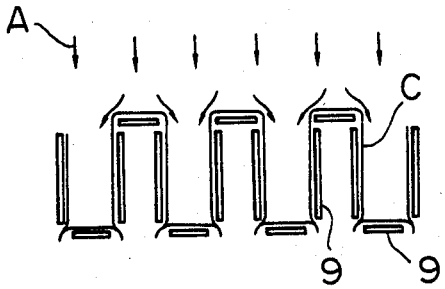

The flame form produced in this embodiment will now be described with reference to FIGS. 5*a* and 5*b*. FIG. 5*a* shows the case where the air ports 9 comprising a number of small holes are arranged in zigzag form. A mixture flow A is first deflected by the secondary air jetted through the air ports 9 on the upstream side to be divided into different small mixture masses following the arrangement of the zigzag-like air ports 9 with a certain appropriate spacing between the adjacent masses. The individual small mixture masses thus divided are continuously supplied with secondary air through the downstream air ports 9 arranged bifurcately, while flowing downwardly. Accordingly, the resultant flame B becomes a steady flame which is formed following the arrangement of the air ports 9 even in the case of using gas fuel having a smaller combustion velocity, so that the flame surface area or combustion reaction area is greatly enlarged and combustion is completed at the more upstream side. It is thus possible to make smaller the flame length without the need to make provision for the secondary air jetted through the air ports 9 to have a paticularly high jet speed. Further, because the individual small mixture masses are spaced from one another with an appropriate spacing, the flame size will never be increased due to flame interference. This permits the lowering of the air blowing pressure of the fan 13 and a remarkable reduction of noise level with effective flame retention and steady flames. It becomes also possible to use the combustion apparatus universally for various types of gas fuel having different physical properties. FIG. 5*b* shows a flame C which is formed in a case where the air ports 9 are arranged in zigzag form using two types of slit holes. High-temperature gas having completed combustion undergoes heat exchange in the heat exchanger 25 to become exhaust gas which is collected into the exhaust hood 26 and then discharged to the atmosphere through an exhaust tube (not shown).

Figure 6A:
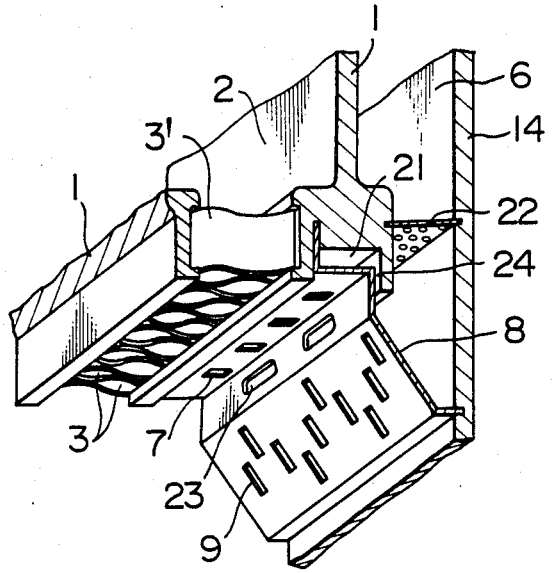
FIG. 6*a* is a partially sectioned perspective view showing another embodiment in which the flame section and air ports in FIG. 4*a* are modified.
Figure 6B:
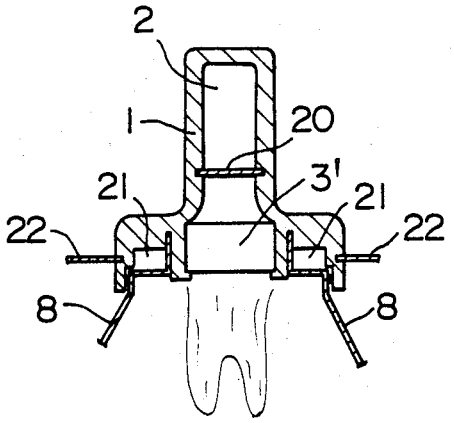
FIG. 6*b* is an explanatory view showing outflow speed distribution of the mixture produced in FIG. 6*a*.

FIGS. 6*a* and 6*b* show another embodiment in which flat plates are bent into zigzag form and arranged so that an S-like flame port 3 comes into contact with an inverted S-like flame port 3 at the central part of the flame port section 3'. In this case, because the flame port section 3' has a larger flame port area at both side ends thereof than that at the central part of the flame port section 3' where the flat plates are contacted with each other, the flowout rate of mixture at both side ends of each flame port near the air ports 9 is larger than that at the central part thereof. Accordingly, even if the secondary air jetted through the air ports 9 is caused to have a smaller jet speed, the secondary air can be supplied sufficiently up to the center of the mixture flow, thus achieving a still further reduction of noise level.

Figure 7:
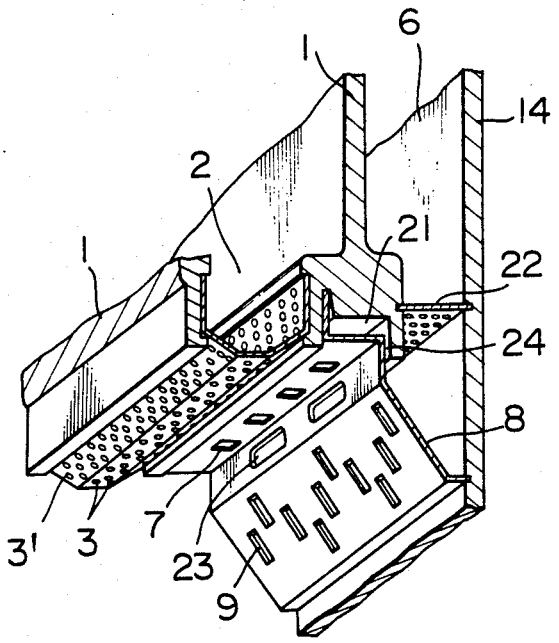
FIG. 7 is a partially sectioned perspective view showing still another embodiment in which the flame port section is modified in FIG. 6*a*.

FIG. 7 shows still another embodiment in which the flame port section 3' is so constructed that a porous plate including a number of small holes as flame ports 3 is bent into a polygonal form and projected into the combustion chamber side. In this case, since the mixture flowing into the combustion chamber 4 faces the secondary air jetted through the air ports 9, the secondary air is supplied sufficiently even with a lower jet speed thereof. This accordingly ensures a further reduction in noise level.

Figure 8A:
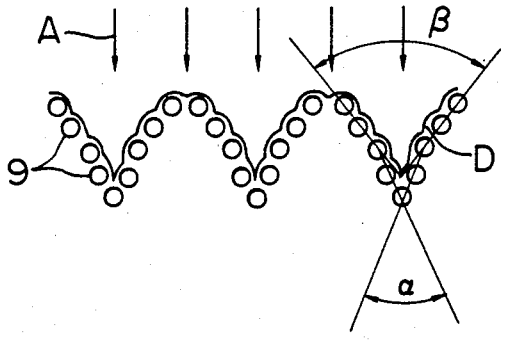
FIGS. 8*a* and 8*b* are explanatory views of flames formed in the case of the larger combustion rate and in the case of the smaller combustion rate, respectively, when the air ports at the crest portion are arranged to project toward the downstream side in the form of a spire.
Figure 8B:
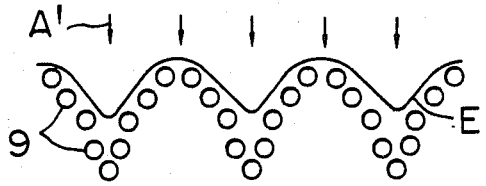
Figure 8C:
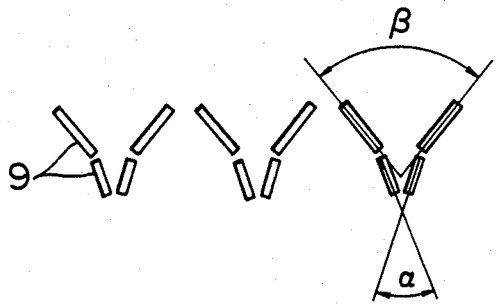
FIG. 8*c* is an arrangement view of the air ports in another embodiment.

FIG. 8*a* shows another embodiment in which the air ports 9 comprising a number of small holes arranged in zigzag form are arranged to have a diverging angle $\alpha$ at the crest portion thereof, smaller than a diverging angle $\beta$ at the root portion thereof. In this case, a flame D formed along the air ports 9 is supplied with a larger quantity of secondary air at the more upstream side, so that combustion will be correspondingly completed at the more upstream side. When the combustion rate is reduced, the flow speed of a mixture A' becomes so small that the mixture will not reach the air ports 9 at the crest portion and a flame E is formed only at the root portion, as shown in FIG. 8*b*. At this time, since the diverging angle $\alpha$ of the air ports at the crest portion is selected to be smaller than the diverging angle $\beta$ thereof at the root portion, an amount of the secondary air that is jetted out of the air ports 9 at the crest portion and will not contribute to combustion reaction of the flame E is less than that obtained in the case where the diverging angle $\alpha$ at the crest portion was not made smaller. As a result, perfect combustion is performed with a smaller air excess ratio, thus increasing heat efficiency of the hot water heater correspondingly. FIG. 8*c* shows an embodiment in which the air ports are arranged in zigzag form likewise using two types of slit holes 9.

What is claimed is:

1. A high load gas combustion apparatus comprising:

a fan for supplying primary and secondary air;

a nozzle having an upstream end connected to a source of fuel;

a mixing tube section for receiving the primary air supplied by said fan and fuel supplied from said nozzle, said primary air and fuel being mixed at the downstream end of said nozzle;

a mixture chamber having an upstream side connected to said mixing tube section;

a flame port section including a plurality of flame ports provided at the downstream side of said mixture chamber;

a combustion chamber provided at the downstream side of said flame port section, said mixture of primary air and fuel being jetted into said combustion chamber through said flame ports; and a pair of air jet plates provided on opposite sides of said flame port section and extending in the lengthwise direction thereof, each of said air jet plates having a plurality of air ports therein extending in said lengthwise direction in a wave-like configuration, secondary air supplied by said fan being jetted into said combustion chamber through said air ports and across the flow of the mixture jetted into said combustion chamber through said flame ports, whereby a continuous flame zone having a wave-like form is generated in said combustion chamber.

2. A high load gas combustion apparatus according to claim 1 wherein said flame port section comprises elongated flat plates bent into a wave-like form with a small curvature in the direction perpendicular to the direction of flow of said mixture so as to form an S-like flame port and an inverted S-like flame port which make contact with each other at the central part of said flame port section.

3. A high load gas combustion apparatus according to claim 1 wherein said flame port section comprises a porous flat plate bent into a polygonal or parabolic form and arranged to project into the combustion chamber.

4. A high load gas combustion apparatus according to claim 1 wherein said air ports are so arranged that the diverging angle of said air ports at the crest portion is smaller than that at the root portion with said crest portion projecting toward the downstream side in the form of a spire.

5. A high load gas combustion apparatus according to claim 1 wherein said flame retention air ports are disposed between said flame port section and those of said air ports located near said flame port section.

6. A high load gas combustion apparatus according to claim 1 wherein said air jet plate is further provided with a plurality of flame retention air ports extending in the lengthwise direction of said flame port section, said secondary air being jetted for flame retention through said flame retention air ports in a direction substantially parallel to the flow of the mixture jetted into said combustion chamber through said flame ports and at a speed lower than that of said mixture.

7. A high load gas combustion apparatus according to claim 6 wherein said flame port section comprises elongated flat plates bent into a wave-like form with a small curvature in the direction perpendicular to the direction of flow of said mixture so as to form an S-like flame port and an inverted S-like flame port which make contact with each other at the central part of said flame port section.

8. A high load gas combustion apparatus according to claim 6 wherein said flame port section comprises a porous flat plate bent into a polygonal or parabolic form and arranged to project into the combustion chamber.

9. A high load gas combustion apparatus according to claim 6 wherein said air ports are so arranged that the diverging angle of said air ports at the crest portion is smaller than that at the root portion with said crest portion projecting toward the downstream side in the form of a spire.

10. A high load gas combustion apparatus according to claim 6 wherein flame retention air ports are disposed between said flame port section and those of said air ports located near said flame port section.

11. A high load gas combustion apparatus comprising:

a fan for supplying primary and secondary air;

a nozzle having an upstream end connected to a source of fuel;

a mixing tube section for receiving the primary air supplied by said fan and fuel supplied from said nozzle, said primary air and fuel being mixed at the downstream end of said nozzle;

at least one mixture chamber having an upstream side connected to said mixing tube section;

a flame port section including a plurality of flame ports provided at the downstream side of said mixture chamber, said flame ports having a relatively large opening ratio;

a combustion chamber provided at the downstream side of said flame port section, said mixture of primary air and fuel being jetted into said combustion chamber through said flame ports;

a burner body having a uniform shape in the lengthwise direction thereof, said burner body incorporating said flame port section and surrounding said mixture chamber;

a plurality of air chambers located on opposite sides of said mixture chamber, said air chambers being separated from said mixture chamber by said burner body and being supplied with secondary air from said fan;

flame retention chambers formed in recesses in said burner body on opposite sides of side flame port section, said flame retention chambers being supplied with a depressurized portion of the secondary air from said air chambers;

air jet plates forming a partition between said combustion chamber and said air chambers and between said combustion chamber and said flame retention chambers, each of said air jet plates having a plurality of air ports therein extending continuously in a wave-like configuration, secondary air supplied by said fan being jetted into said combustion chamber through said air ports and across the flow of the mixture jetted into said combustion chamber through said flame ports, whereby a continuous flame zone having a wave-like form is generated in said combustion chamber, said flame portion section having a plurality of flame retention air ports extending in the lengthwise direction thereof, said secondary air being jetted for flame retention through said flame retention air ports in a direction substantially parallel to the flow of the mixture jetted into said combustion chamber through said flame ports.

12. A high load gas combustion apparatus according to claim 11 wherein said flame port section comprises elongated flat plates bent into a wave-like form with a small curvature in the direction perpendicular to the direction of flow of said mixture so as to form an S-like flame port and an inverted S-like flame port which make contact with each other at the central part of said flame port section.

13. A high load gas combustion apparatus according to claim 11 wherein said flame port section comprises a porous flat plate bent into a polygonal or parabolic form and arranged to project into the combustion chamber.

14. A high load gas combustion apparatus according to claim 11 wherein said air ports are so arranged that the diverging angle of said air ports at the crest portion is smaller than that at the root portion with said crest portion projecting toward the downstream side in the form of a spire.

15. A high load gas combustion apparatus according to claim 11 wherein each of said air jet plates is provided with a plurality of small projections between said air ports and said flame retention air ports thereby forming a plurality of small gaps between the recess in said burner body and said air chambers for connecting said air chambers with said flame retention chambers, whereby said secondary air is supplied to said flame retention chambers from said air chambers under reduced pressure.

16. A high load gas combustion apparatus according to claim 11 wherein said flame retention air ports are disposed between said flame port section and those of said air ports located near said flame port section.

* * * * *